US005564786A

United States Patent [19]

Peek et al.

[11] Patent Number: 5,564,786

[45] Date of Patent: Oct. 15, 1996

[54] MODULAR ADJUSTABLE SEAT FRAME FOR WHEELCHAIRS

[75] Inventors: Gregory A. Peek; William B. Lytle, both of Highlands Ranch; John A. Dyer, Evergreen, all of Colo.

[73] Assignee: LaBac Systems, Inc., Lakewood, Colo.

[21] Appl. No.: 337,606

[22] Filed: Nov. 10, 1994

[51] Int. Cl.[6] ..... A47C 7/02

[52] U.S. Cl. ..... 297/452.4; 297/452.2; 297/DIG. 4; 280/250.1; 280/647; 280/650

[58] Field of Search ..... 297/452.18, 452.2, 297/440.1, 440.24, 440.14, 452.4, DIG. 4, 284.1; 280/250.1, 42, 650, 647

[56] References Cited

U.S. PATENT DOCUMENTS

| | | | |
|---|---|---|---|
| 3,759,572 | 9/1973 | Koepke | 297/452.4 |
| 3,937,490 | 2/1976 | Nasr | 280/250.1 |
| 3,945,449 | 3/1976 | Ostrow | 280/250.1 X |
| 4,643,479 | 2/1987 | Servi | 297/440.24 X |
| 4,655,471 | 4/1987 | Peek . | |
| 5,020,816 | 6/1991 | Mulholland | 280/42 X |
| 5,044,647 | 9/1991 | Patterson . | |
| 5,050,899 | 9/1991 | Stensby | 297/DIG. 4 X |
| 5,137,295 | 8/1992 | Peek . | |
| 5,294,141 | 3/1994 | Mentessi et al. | 280/250.1 |

*Primary Examiner*—Milton Nelson, Jr.
*Attorney, Agent, or Firm*—Holland & Hart LLP

[57] ABSTRACT

A seat frame for mounting on a chair frame for supporting a seat pad and seat back. The frame is formed by a pair of spaced apart side rails, each rail having a plurality of spaced apart parallel transverse mounting beams extending therefrom towards the opposite rail. A central beam is telescopingly and releasably engaged between each corresponding mounting beam on the rails. Chair frame mounting fittings and seat back mounting fittings are releasably secured to the side rails.

2 Claims, 3 Drawing Sheets

MODULAR ADJUSTABLE SEAT FRAME FOR WHEELCHAIRS

BACKGROUND OF THE INVENTION

1. Field of the Invention

The present invention relates to seat frames supporting a seat pad and seat back. Most particularly, the invention relates to seat frames, finding particular but not exclusive utility for wheelchairs with reclining and tilting seats.

2. Brief Description of the Prior Art

Seat frames for wheel chairs serve to mount the wheelchair seat on the wheelchair frame and enable the seat to be stationary, tilted or reclined. Wheelchair seats are shown, for example, in U.S. Pat. No. 5,137,295 and U.S. Pat. No. 4,655,471.

OBJECTS AND ADVANTAGES

It is the principal object of the present invention to provide an improved seat frame for use with tilting and reclining seat structures.

A more specific object of the present invention is to provide a seat frame structure which is modular in configuration in order to be adaptable for use with a wide variety of sizes and configuration of tilting and reclining seats.

SUMMARY OF INVENTION

The present invention is embodied in a seat frame mountable on a chair frame for supporting a seat pad and seat back. The frame is formed by a pair of spaced apart side rails, each rail having a plurality of spaced parallel transverse mounting beams extending therefrom towards the opposite rail. A central beam is telescopingly and releasably engaged between each corresponding mounting beam on the rails. Chair frame mounting fittings and seat back mounting fittings are releasably secured to the side rails.

DESCRIPTION OF THE PREFERRED EMBODIMENTS

Figure 1:
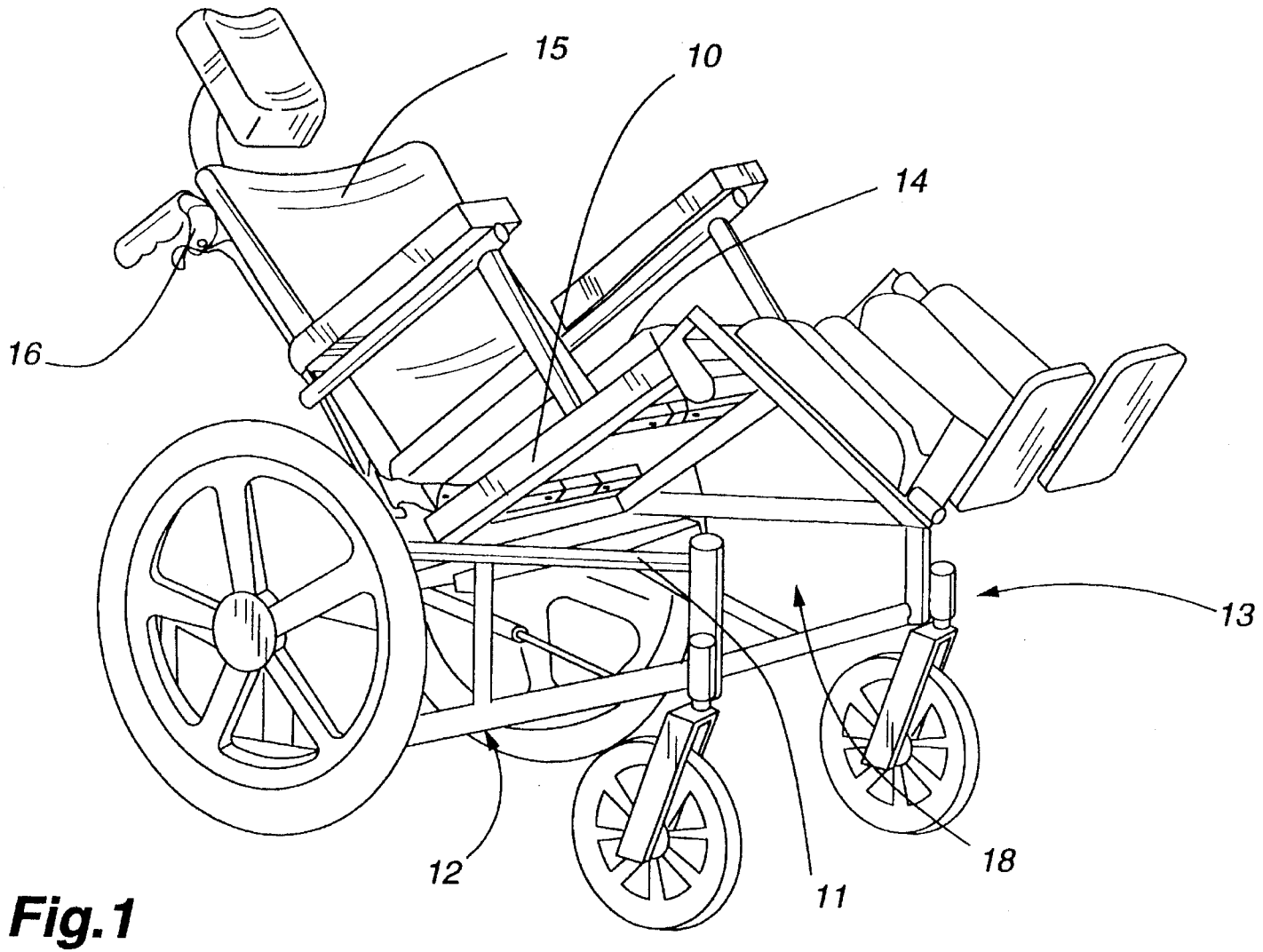
FIG. 1 is a perspective view of a wheelchair mounting and seat frame embodying the present invention.

The present invention is embodied in a modular seat frame 10 adapted to be mounted on a chair frame 11 such as the frame 12 of a wheelchair 13 or the like. As shown in FIG. 1, the modular seat frame 10 supports a seat pad 14 and seat back 15. The frame 10 is mounted on the chair frame 12 both for tilting of the seat and back with respect to the chair frame and for reclining of the seat back 15 with respect to the seat pad 14. For the foregoing purposes, a back reclining mechanism 16 can be provided together with a seat and back tilting mechanism 18.

Figure 2:
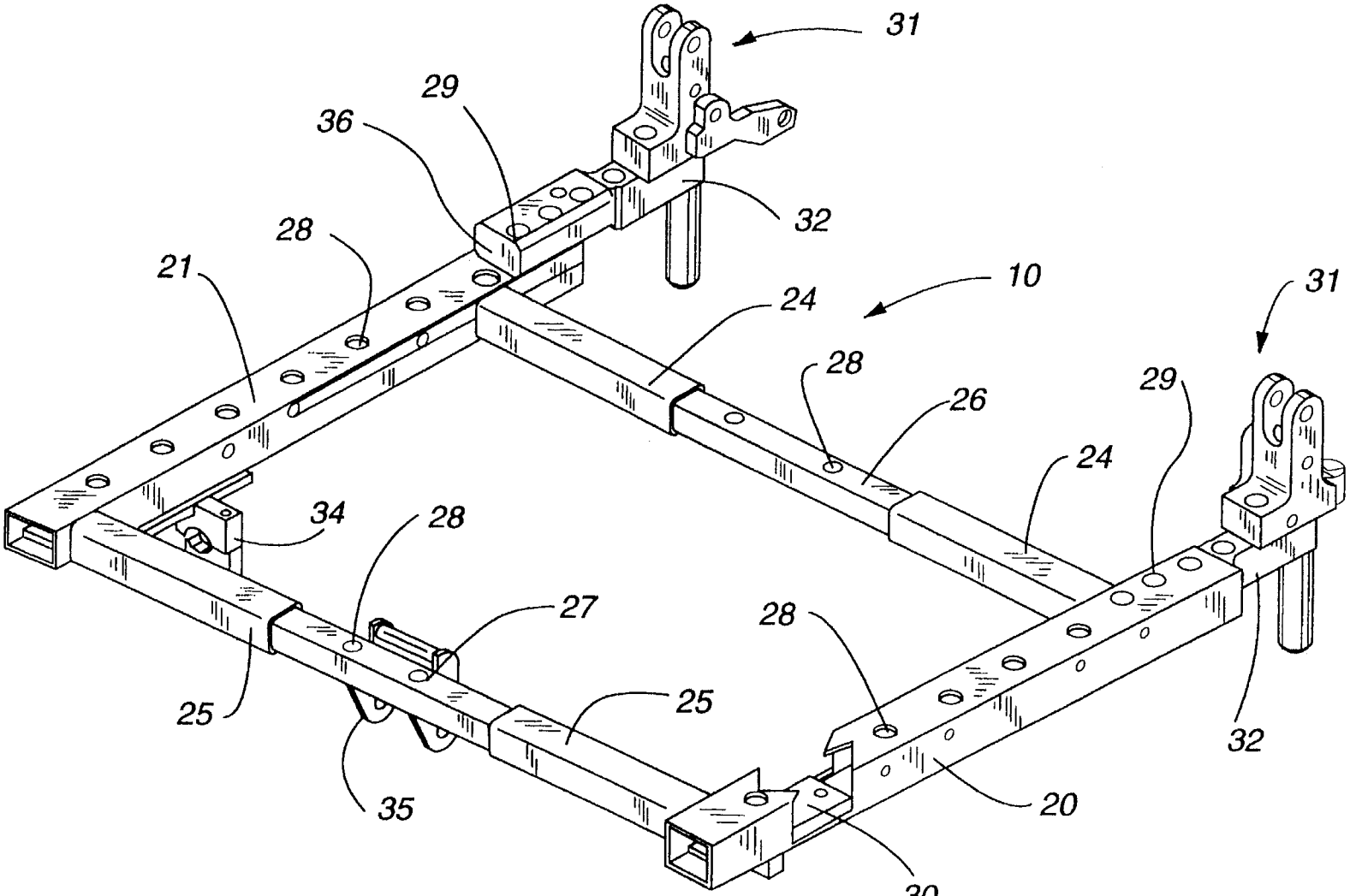
FIG. 2 is a perspective view of a seat frame embodying the present invention with parts broken away for clarity.
Figure 3:
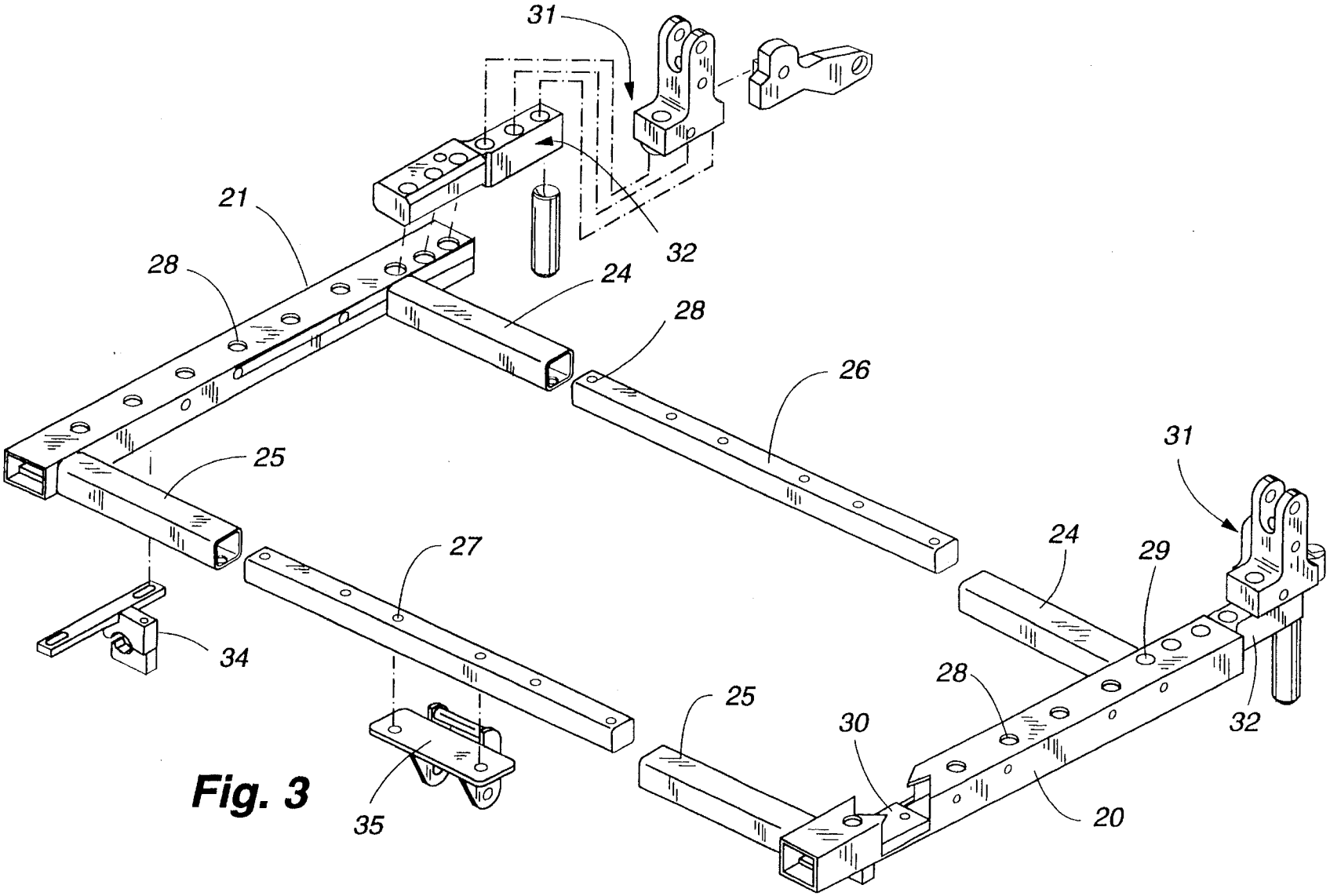
FIG. 3 is an exploded perspective view of the seat frame shown in FIG. 2.

The seat frame 10 embodying the present invention is formed by a pair of spaced parallel side beams or rails 20, 21 (FIG. 2). Each rail has two or more spaced laterally extending cantilever channels or tubular beams 24, 25 secured thereto in spaced relation along the length of the respective rail and extending laterally therefrom. When the side rails 20, 21 are aligned as the sides of a seat frame, the corresponding lateral tube beams 24, 25 of each side rail project towards each other and are joined by central tubular beams 26, 27 which telescope at each end with the corresponding tubes 24, 25 to form a rectangular seat frame 20. The seat pad 14 is then secured on top of the frame 20.

The spaced parallel beams 20, 21 are adjustable in lateral spacing to define a frame of selected width. For securing the beams or tubes together, the beams are provided with fastener apertures 28, and appropriate threaded screw and nut or other fastener devices 29 may be utilized with appropriate apertures in each of the beams and tubes. Insert fastener plates 30 may be used where needed. A variety of threaded or clamp fasteners 29 may be utilized to provide versatility of adjustment, thus enabling adjustable spacing between the parallel side rails 20, 21 while providing a stable, rigid seat frame. Additional cross beams (not shown) may be provided for additional strength.

For mounting the modular seat frame 10 to the chair base or frame 11 and for mounting the upstanding seat back 15 on the modular seat frame 10, appropriate fitting blocks 31 are utilized. The blocks 31 include insert plugs or blocks 32 adapted to be secured to or inserted into an open end of the parallel side rails 20, 21 and secured therein by appropriate threaded fasteners 29. Wheelchair hardware such as pivot blocks, pins and the like can be secured to the insert blocks, again by threaded or other appropriate fasteners, to provide for a variety of connecting units. Similarly, at the front end of the seat, modular blocks 34 can be provided with tubes and the like for supporting footrests and other rails.

Mounting and pivot blocks 35 can be secured to the central beams 27 of the modular seat frame 10 for purposes of attaching, lifting and tilting piston rods. For lengthening the parallel side rails 20, 21, insert extension blocks 36 can be inserted into or mounted on the open front end of the side rails. Appropriate front end hardware can be readily secured to such extension blocks.

In the foregoing manner, a wide variety of seat configurations, mounting blocks, seat and back pivot and tilting structures can be provided. Various accessories can be readily secured to the modular parallel side beams as well as to the central beams for purposes of tilting and reclining the seat structure.

While the various beams and tubes have been shown in the drawings as being generally rectangular in cross-section, other cross-sectional configurations such as cylindrical elements or channels can be utilized.

While a certain preferred embodiment of the present invention has been shown in the drawings and described above in detail, it should be understood that there is no intention to limit the invention to the specific form disclosed. On the contrary, the intention is to cover all modifications, alternative constructions, equivalents and uses falling within the spirit and scope of the invention as expressed in the appended claims.

I claim:

1. A seat frame mountable on a chair frame and comprising a pair of spaced apart side rails, each said rail having a plurality of spaced parallel transverse mounting beams extending therefrom towards the opposite rail, a central beam telescopingly releasably engaged between corresponding mounting beams on each said rail, chair frame mounting fittings releasably secured to said side rails, seat back mounting fittings releasably secured to said side rails, and a lift piston mounting fitting secured to a central beam, whereby said seat frame is customizable to dimensions specified by an individual user.

2. A seat frame as defined in claim 1 further comprising extension brackets connecting said seat back mounting fittings and said side rails.

* * * * *